United States Patent [19]

Bene

[11] Patent Number: 5,014,525

[45] Date of Patent: May 14, 1991

[54] MACHINE FOR DYEING FABRIC IN A ROPE

[75] Inventor: Armand Bene, Saint Priest, France

[73] Assignee: Madinox S.A., Mi Plaine, France

[21] Appl. No.: 425,720

[22] Filed: Oct. 24, 1989

[51] Int. Cl.[5] ..... D06B 3/28

[52] U.S. Cl. ..... 68/20; 15/306.1; 34/156; 68/178; 226/97

[58] Field of Search ..... 68/177, 178, 20; 15/306 R, 306 A; 226/97; 34/156, 160

[56] References Cited

U.S. PATENT DOCUMENTS

| | | | |
|---|---|---|---|
| 1,556,057 | 10/1925 | Wheller | 34/156 |
| 2,351,549 | 6/1944 | Schwartz | 34/160 X |
| 3,156,395 | 11/1964 | Ashby et al. | 226/97 X |
| 3,183,605 | 5/1965 | Argue et al. | 34/160 X |
| 3,286,896 | 11/1966 | Kinney | 226/97 |
| 3,655,862 | 4/1972 | Dorschner et al. | 226/97 X |
| 3,698,212 | 10/1972 | Ameling et al. | 68/178 |
| 3,802,840 | 4/1974 | Chiba et al. | 8/152 |
| 3,904,098 | 9/1975 | Kopperman et al. | 226/97 |
| 4,215,805 | 8/1980 | Nielsen | 226/97 |
| 4,360,937 | 11/1982 | Putnam | 68/178 X |
| 4,766,743 | 8/1988 | Biancalani et al. | 68/178 X |

FOREIGN PATENT DOCUMENTS

| | | | |
|---|---|---|---|
| 2207679 | 8/1973 | Fed. Rep. of Germany . | |
| 2108340 | 5/1972 | France . | |
| 2412637 | 7/1979 | France . | |
| 2450895 | 10/1980 | France . | |
| 2619834 | 3/1989 | France | 226/97 |
| 1587069 | 3/1981 | United Kingdom | 68/178 |
| 2158472 | 11/1985 | United Kingdom . | |

*Primary Examiner*—Philip R. Coe
*Attorney, Agent, or Firm*—Oliff & Berridge

[57] ABSTRACT

This machine has a tunnel traversed axially by fabric rope, itself disposed inside a chamber supplied with pressurized air from an enclosure which is, disposed inside the machine and contains a centrifugal fan. The tunnel communicates with the chamber (12) through at least one opening which is inclined with respect to the axis of the tunnel in the direction of movement of the rope.

12 Claims, 2 Drawing Sheets

MACHINE FOR DYEING FABRIC IN A ROPE

TECHNICAL FIELD

The present invention relates to a machine for dyeing fabric in a rope.

BACKGROUND OF THE INVENTION

In a chain-dyeing machine, the rope of fabric, joined to itself, forms a continuous loop of variable length. This loop is stored in the lower part of the machine, which forms a basket that is more or less submerged in the dyebath, substantially in the form of an accordion fold. Part of the loop is located above the storage zone, and passes over or through guides and drive means that move the loop formed by the rope, so that it executes one rotation in about 3 minutes.

In general, the rope-drive means are composed of a motorized roller, which has the disadvantage of exerting a substantial mechanical force on the fabric; this might harm the fabric if it is fragile, and also fold the fabric, resulting in structural and processing defects in the finished fabric. In certain machines, known as "jet" machines, the dyebath is sprayed onto the rope outside the storage zone, and participates partially in the displacement of the rope. In other machines, air or a gaseous fluid is used to inflate or smooth the rope, also participating in displacement of the rope.

Such machines, which have the above-mentioned disadvantages of mechanically driven machines, also have the disadvantage of being more complex and hence more expensive to build and maintain.

SUMMARY OF THE INVENTION

The goal of the present invention is to furnish a machine for processing fabric in a rope, equipped with means having a simple structure allowing the rope to move without deteriorating.

For this purpose, this machine has a tunnel traversed axially by the fabric rope, said tunnel being disposed inside a chamber supplied with pressurized air from an enclosure that is disposed inside the machine and contains a centrifugal fan. The tunnel communicates with the chamber by at least one opening inclined with respect to the axis of the tunnel in the direction of movement of the rope.

This technique allows the rope to be moved by the action of the air with no mechanical drive that would generate defects in the fabric, allowing the fabric and fragile fabrics that tolerate mechanical forces poorly to be handled gently, while benefiting from air that is at the temperature of the machine because it is taken from the inside thereof.

According to one embodiment of this machine, each opening providing communication between the tunnel and the chamber opens into the tunnel upstream of a converging zone, itself followed by a diverging zone.

Advantageously, the passage providing the communication between the chamber and the enclosure containing the fan is equipped with a slide for adjusting its cross section, the position of said slide being a function of the rate of travel of the rope. This allows the speed of the rope to be set to a reference speed by altering the air flowrate.

According to another option, the air intakes orifice of the fan is equipped with a slide allowing the air passage cross section to be adjusted.

Adjustment of the air passage cross section ahead of the fan allows the rope drive speed to be adjusted. This is a simple solution, and far more economical than one involving changing the rotational speed of the motor associated with the fan.

According to one embodiment of this machine, the tunnel intended for passage of the rope has several axially displacement segments between which are provided the air propulsion openings, the upstream part of the first segment having a circular or ovoid cross section and this segment being an intake zone into which the rope is drawn while the segments located downstream have a rectangular section whose larger dimension is horizontal and whose smaller dimension is vertical, these segments being the blowing zones in which the rope is entrained by air pressure.

The change in the cross section of the tunnel over its length ensures flattening of the rope, which has the effect of improving lift and favoring the pneumatic transport conditions, and ensuring appropriate positioning of the rope when it arrives at the storage zone located downstream of the tunnel.

According to another characteristic of the invention, the tunnel designed for passage of the rope has a substantially horizontl axis and is extended at its downstream end, and at the upper part of the tunnel, by an adjustable slide forming a guide for the fabric. The purpose of this slide is to help store the rope in the storage zone.

Advantageously, the part of the tunnel that forms the upstream segment thereof is mounted to be axially adjustable inside the pressurized air intake chamber. This allows the pneumatic transport conditions to be adapted to the type of fabric to be treated.

According to one embodiment of this machine, the part of the tunnel forming the second segment has, viewed in vertical section, from upstream to downstream, a converging zone, a slowly diverging zone, then a second converging zone, with the end of the first segment being engaged in the converging zone forming the upstream end of the second segment and delimiting therewith openings for passage of air, while the second converging zone delimits with the wall of the pressurized air intake chamber, openings for passage of the air.

The second segment has a Venturi shape which brings about the desired pneumatic effects, namely vacuum in the first segment and pressure in the following segments.

Advantageously, the enclosure containing the fan is disposed at the center of the loop formed by the rope and below the tunnel serving to drive it.

BRIEF DESCRIPTION OF THE DRAWINGS

In any event, the invention wil be well understood with the aid of the description hereinbelow with reference to the schematic diagram attached showing, as non-limiting examples, several embodiments of this machine in which.

DETAILED DESCRIPTION OF PREFERRED EMBODIMENTS

Figure 1:
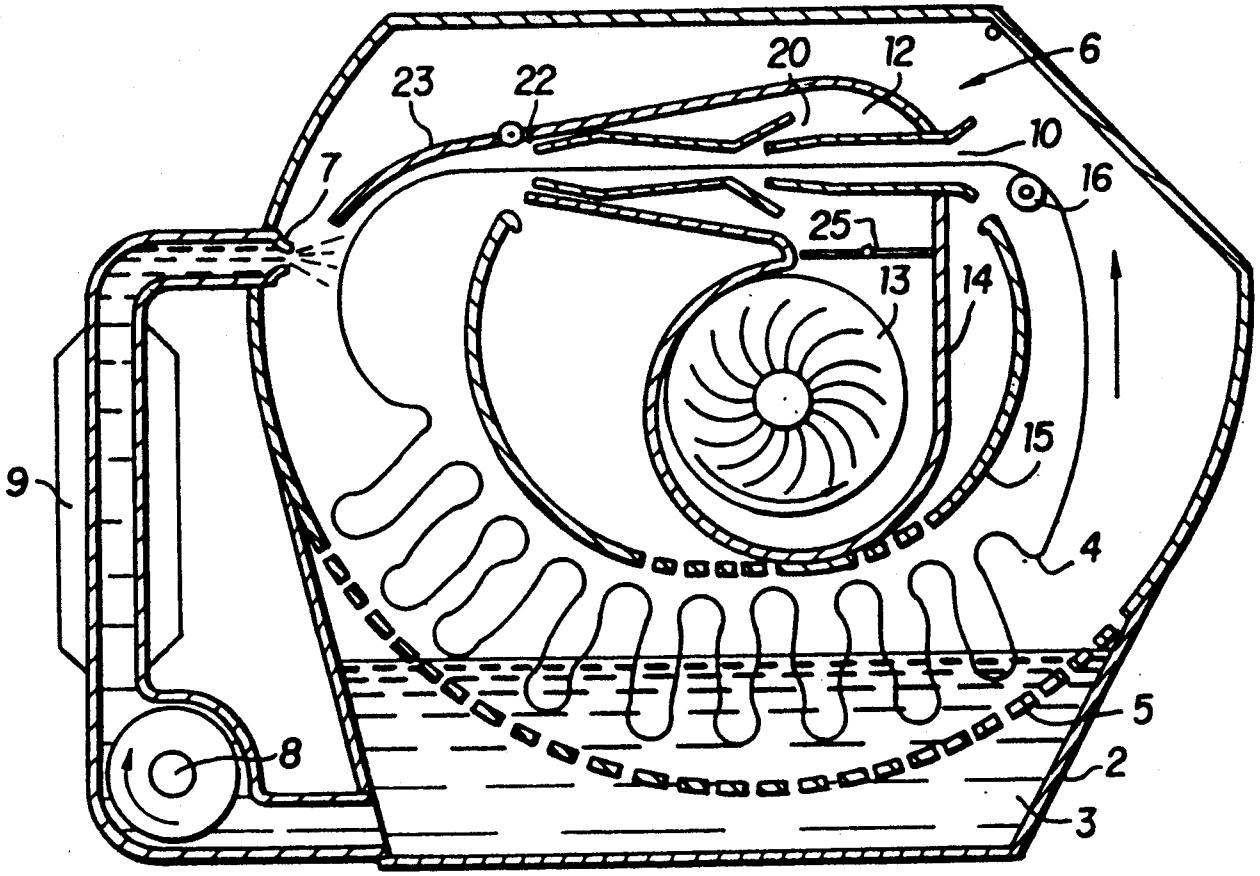
FIG. 1 is a cross section of a dyeing machine.

The machine shown in FIG. 1 is composed of a dyeing machine having an enclosure 2 in the bottom of which is disposed dyeing bath 3. Fabric rope 4 is joined to itself to form a continuous loop which is driven inside the machine. Fabric rope 4 rests on the lower part of the machine, on perforated sheet metal 5 constituting a storage surface where the rope is disposed in an accordion fold. In the upper part of the machine, the rope is driven rotationally by means designated by general reference 6 which will be defined below, said rope undergoing spraying in the dyebath from at least one nozzle 7, the dyebath being brought to this nozzle by a circulating pump 8 after passing through a heat exchanger 9.

Means 6 ensuring the advance of the fabric rope are, according to the essential characteristic of the invention, solely pneumatic. These means are composed of a tunnel 10 traversed lengthwise by the rope of fabric, mounted inside a pressurized air distribution chamber 12, which itself is supplied with air from a centrifugal fan 13 disposed inside an enclosure 14 located at the center of the loop formed by the rope. The path of the rope is delimited, on the inside, by a piece of sheet metal 15 whose bottom has several perforations for evacuation of the dyebath which can be collected at this level.

It should be noted that fabric rope 4 penetrates to tunnel 10 after coming in contact with a roller 16 mounted loosely on its axis, and designed to control the regularity of the rope travel speed.

Figure 7:
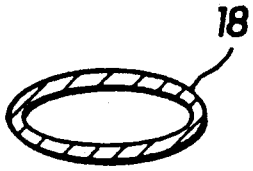
FIG. 7 is a cross-section through line IV of FIG. 3 illustrating a second embodiment of the invention wherein an ovoid cross-section is used.
Figure 2:
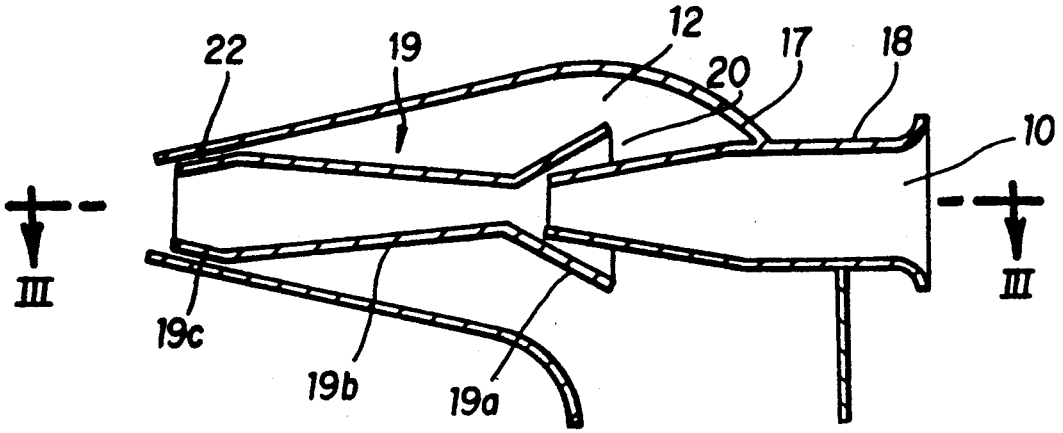
FIG. 2 is a lengthwise section through a vertical plane and on an enlarged scale, of the rope-transport device.
Figure 3:
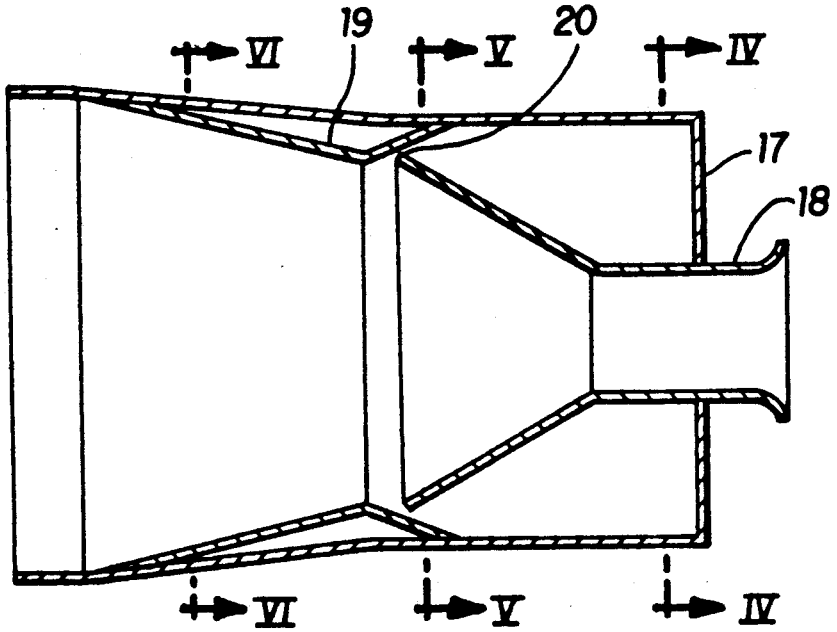
FIG. 3 is a section through a horizontal plane of this transfer device, along line III—III in FIG. 2.
Figure 6:
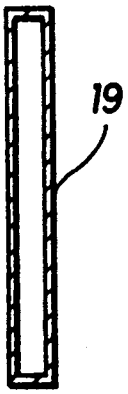
FIGS. 4 to 6 are three cross sections through the transfer device along line IV—IV, V—V and VI—VI of FIG. 3, respectively.
Figure 5:
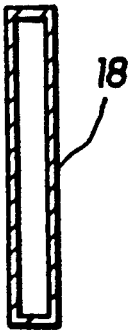
Figure 4:
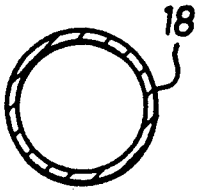

As shown in FIG. 2, air distribution chamber 12 is delimited by a wall 17 which has an openig for passage of the upstream end of tunnel 10. The upstream end of tunnel 10 is composed of a first tubular part 18 whose position is axially adjustable with respect to jacket 17. As can be seen in FIGS. 4 and 5, the upstream end of part 18 has a circular section, while its downstream end has a rectangular section. As shown in FIG. 7, the circular cross-section can also be ovoid in shape. The second segment of tunnel 10 is delimited by a jacket 19 comprising a first converging part 19*a* inside of which is engaged the downstream end of first part 18, whereby parts 18 and 19*a* provide openings 20 for passage of the pressurized air. Converging part 19*a* extends as a diverging part 19*b*, itself extended by a converging part 19*c*, delimiting with the jacket of chamber 12, openings 22 for passage of air under pressure. As can be seen from FIG. 6, the cross section of the second segment of the tunnel is also rectangular, its larger dimension being horizontal and its smaller dimension, vertical. At the downstream end of the tunnel is mounted, at the upper part thereof, an adjustable deflector 23, ensuring the fall of the rope to the storage zone. The combination of this deflector 23 and the rectangular section of the downstream end of the tunnel allow an accordion fold to be made in the rope at the bottom of the machine, under good conditions.

The machine as shown in the drawing allows the rope to be driven, without mechanical elements, between a linear speed of about 800 m/min for light fabrics and a speed of about 100 m/min for heavier fabrics, the essential point being that the travel of the fabric is such that the rope essentially completes one rotation every three minutes.

The rate of travel of the rope may be adjusted by a slide 25 which closes off to a greater or lesser extent, the opening providing communication between enclosure 14 containing fan 13 and air distribution chamber 12.

It is advantageous, for a textile of a given type, to establish a rope circulation speed. The measured speed controls the position of slide 25 to adjust the air flowrate, to adjust the speed of the rope to the set speed. It is possible, for example, to measure the speed at roller 16, or by activating an electromagnetic sensor with the aid of an element such as a magnet attached to the rope. It is also possible to adjust the air inlet cross section of fan 13.

I claim:

1. A machine for dyeing a rope of fabric, comprising a tunnel capable of being traversed axially by fabric rope, said tunnel being disposed inside a chamber, means for supplying pressurized air from an enclosure to said chamber, said tunnel communicating with said chamber through at least one opening inclined with respect to an axis of said tunnel in a direction of movement of the rope, said tunnel including several segments staggered axially, said at least one opening being provided between said segments, an upstream part of a first segment having a round cross-section, said first segment being in intake zone into which rope is drawn, a second segment located downstream of said first segment having a rectangular cross-section whose larger dimension is horizontal and smaller dimension vertical, said segments forming blowing zones in which rope can be entrained by air pressure, and dyeing means for contacting rope with a dye.

2. The machine according to claim 1, wherein said at least one opening which provides communication between said tunnel and said chamber is located upstream of a converging zone in said tunnel, said converging zone being followed by a diverging zone in said tunnel.

3. The machine according to claim 1, further comprising a passage providing communication between said chamber and said enclosure, said passage being equipped with a slide for adjusting a cross section of said passage.

4. The machine according to claim 3, further comprising means for controlling the position of said slide based upon a sensed rate of travel of rope through said tunnel.

5. The machine according to claim 1, wherein an air inlet of said means for supplying pressurized air includes a slide, allowing an air passage cross section to be adjusted.

6. The machine according to claim 1, wherein said tunnel includes an essentially horizontal axis, said tunnel being extended at an upper portion of a downstream end by an adjustable slide forming a guide for fabric.

7. The machine according to claim 1, wherein said first segment is mounted axially adjustably inside said chamber.

8. The machine according to claim 7, wherein said second segment, as seen in vertical section from an upstream end to a downstream end, includes a first converging zone, a slowly diverging zone and a second converging zone, the end of the first segment being engaged in the first converging zone forming the upstream end of the second segment and delimiting therewith, said at least one opening for passage of air, while the second converging zone delimits with a wall of said pressurized-air intake chamber, additional openings for passage of air.

9. The machine according to claim 1, further comprising a housing, said enclosure and tunnel being mounted within said housing with said enclosure being located below said tunnel, said housing defining a loop-shaped pathway for guiding a rope therethrough, said enclosure being disposed in a center of said pathway, said means for supplying pressurized air serving to entrain rope through said tunnel, said dyeing means being located in said housing along said loop-shaped pathway.

10. The machine according to claim 1, wherein said means for supplying pressurized air includes a centrifugal fan.

11. The machine according to claim 1, wherein said round cross section is circular.

12. The machine according to claim 1, wherein said round cross section is ovoid.

* * * * *